US010490946B2

(12) United States Patent
Sakaizawa et al.

(10) Patent No.: US 10,490,946 B2
(45) Date of Patent: Nov. 26, 2019

(54) CONNECTOR

(71) Applicant: HIROSE ELECTRIC CO., LTD., Tokyo (JP)

(72) Inventors: Tadashi Sakaizawa, Tokyo (JP); Kenichi Naganuma, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/062,776

(22) PCT Filed: Nov. 10, 2016

(86) PCT No.: PCT/JP2016/083331
§ 371 (c)(1),
(2) Date: Jun. 15, 2018

(87) PCT Pub. No.: WO2017/104311
PCT Pub. Date: Jun. 22, 2017

(65) Prior Publication Data

US 2019/0013624 A1 Jan. 10, 2019

(30) Foreign Application Priority Data

Dec. 18, 2015 (JP) ..... 2015-246889

(51) Int. Cl.
*H01R 4/66* (2006.01)
*H01R 13/6473* (2011.01)
(Continued)

(52) U.S. Cl.
CPC ..... *H01R 13/6473* (2013.01); *H01R 12/716* (2013.01); *H01R 13/6581* (2013.01); *H01R 24/64* (2013.01); *H01R 2107/00* (2013.01)

(58) Field of Classification Search
CPC .. H01R 13/6473; H01R 24/64; H01R 12/716; H01R 13/6581; H01R 2107/00
(Continued)

(56) References Cited

U.S. PATENT DOCUMENTS 6,280,209 B1 * 8/2001 Bassler ..... H01R 12/724 439/101
6,379,184 B1 * 4/2002 Bassler ..... H01R 13/6625 439/607.27
(Continued)

FOREIGN PATENT DOCUMENTS

CN 2491977 Y 5/2002
CN 104505648 A 4/2015
(Continued)

OTHER PUBLICATIONS

International Search Report dated Jan. 31, 2017 filed in PCT/JP2016/083331.
(Continued)

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

In a typical connector, one or more ground terminals need to be, in addition to signal terminals, arranged between signal terminals formed in pairs or between one signal terminal pair and the other signal terminal pair. This leads to a problem that the number of components forming the connector is increased and an internal structure of the connector is complicated. A connector is provided, which is a substrate-side connector including two terminal groups arranged along a connector fitting direction to face each other, an insulator holding the terminal groups, and an outer conductor shell housing the insulator. In the substrate-side
(Continued)

connector, a shell mounting portion for mounting the outer conductor shell on a substrate is, passing through between the two terminal groups, mounted between a mounting portion for a group of terminals of multiple terminals included in one terminal group and a mounting portion for a group of the terminals of multiple terminals included in the other terminal group. With this configuration, the shell mounting portion of the outer conductor shell can function as a ground terminal.

6 Claims, 4 Drawing Sheets

(51) Int. Cl.
*H01R 13/6581* (2011.01)
*H01R 24/64* (2011.01)
*H01R 12/71* (2011.01)
*H01R 107/00* (2006.01)

(58) Field of Classification Search
USPC ..... 439/607.05, 607.35, 607.37, 607.4
See application file for complete search history.

(56) References Cited

U.S. PATENT DOCUMENTS 7,806,704 B2 * 10/2010 Miyoshi ..... H01R 13/6461 439/108
8,979,584 B2 * 3/2015 Tsuchiya ..... H01R 12/724 439/607.27
9,401,568 B1 * 7/2016 Masuda ..... H01R 13/6581
9,590,364 B1 * 3/2017 Chang ..... H01R 13/6581
9,673,569 B2 * 6/2017 Zhang ..... H01R 13/6585
9,692,166 B2 * 6/2017 Kao ..... H01R 24/60
9,893,473 B2 * 2/2018 Kong ..... H01R 13/6594
9,997,850 B2 * 6/2018 Hong ..... H01R 12/716
2003/0017730 A1 * 1/2003 Bassler ..... H01R 9/034 439/108
2003/0032316 A1 * 2/2003 Bassler ..... H01R 12/724 439/108
2007/0105440 A1 * 5/2007 Delaney ..... H01R 12/714 439/607.36
2008/0014803 A1 1/2008 Kato et al.
2015/0340798 A1 * 11/2015 Kao ..... H01R 13/516 439/660
2016/0013591 A1 * 1/2016 Ueda ..... H01R 13/6581 439/607.28
2017/0271820 A1 9/2017 Ho
2018/0191092 A1 * 7/2018 Zhou ..... H01R 12/716

FOREIGN PATENT DOCUMENTS

EP 0832510 A1 4/1998
JP 2009515317 A 4/2009
JP 4439540 B2 3/2010
JP 2012054173 A 3/2012
WO 2015/181629 A2 12/2015

OTHER PUBLICATIONS

Extended European Search Report (EESR) dated Jul. 12, 2019 issued in the corresponding European patent application No. 16875295.4.
Office Action dated Apr. 12, 2019 for the corresponding Chinese Patent Application No. 201680065457.8; Machine translation.

* cited by examiner

CONNECTOR

TECHNICAL FIELD

The present invention relates to a connector suitable for high-speed electric signal transfer. Specifically, the present invention relates to a multi-terminal structure arranged and configured so that impedance matching can be maintained at multiple terminals included in a connector.

BACKGROUND ART

A connector used upon transfer of an electric signal and the like generally includes an insulator configured to hold multiple conductive terminals, and an outer conductor shell configured to house the insulator. For example, a connector described in Japanese Patent No. 4439540 (Patent Literature 1) is configured such that a ground terminal is provided in addition to signal terminals to be formed in pairs and is arranged between the signal terminals to be formed in pairs or between one signal terminal pair and the other signal terminal pair.

CITATION LIST

Patent Literature

PATENT LITERATURE 1: Japanese Patent No. 4439540

SUMMARY OF THE INVENTION

Problems to be Solved by the Invention

In recent years, the capacity of a data processing apparatus mounted on an electronic device such as a measurement device or an audio/video (AV) device has been improved, and therefore, an enormous quantity of data can be processed in the electronic device. Accordingly, a large quantity of data is, as an electric signal, transmitted/received at high speed via a connector. For properly transferring such a high-frequency electric signal, in the connector described in Japanese Patent No. 4439540 (Patent Literature 1), e.g., impedance matching disturbance caused between the signal terminals can be reduced by the ground terminal, and desired high-frequency characteristics can be obtained, for example.

However, in such a ground terminal, one or more ground terminals need to be, in addition to the signal terminals, arranged between the signal terminals to be formed in pairs or between one signal terminal pair and the other signal terminal pair. This leads to a problem that the number of components forming the connector is increased and an internal structure of the connector is complicated. Moreover, due to the complicated internal structure of the connector, it is difficult to establish impedance matching.

For solving the above-described problems, a connector is provided, which is a substrate-side connector including two terminal groups arranged along a connector fitting direction to face each other, an insulator holding the terminal groups, and an outer conductor shell housing the insulator. In the substrate-side connector, a shell mounting portion for mounting the outer conductor shell on a substrate is, passing through between the two terminal groups, mounted between a mounting portion for a group of terminals of multiple terminals included in one terminal group and a mounting portion for a group of terminals of multiple terminals included in the other terminal group. With this configuration, the shell mounting portion of the outer conductor shell can function as a ground terminal.

Solution to the Problems

A connector according to one embodiment of the present invention is a connector including

- an outer conductor shell,
- two terminal groups arranged along a connector fitting direction to face each other, and
- an insulator housed in the outer conductor shell the insulator holding the two terminal groups.

Each of the two terminal groups includes at least one or more terminal pairs of two terminals.

Each terminal of the terminal pair included in each of the two terminal groups includes

- at a tip end side portion of the connector, a contact portion to be connected in contact with a terminal of a partner connector, and
- at a back end side portion of the connector, a terminal mounting portion to be mounted on a substrate.

The outer conductor shell includes a shell mounting portion for mounting on the substrate, and a ground terminal also serving as a shell mounting portion on a back end side.

The ground terminal is mounted on a substrate between a mounting portion for a group of terminals included in one terminal group of the two terminal groups and a mounting portion for a group of terminals included in the other terminal group.

In a preferable embodiment of the connector according to the present invention, the ground terminal is mounted on the substrate passing through between the exposed two terminal groups coming out of the insulator.

In a preferable embodiment of the connector according to the present invention, the ground terminal is in a shape extending perpendicularly to the substrate such that mounting is allowed with the ground terminal being inserted into a hole provided at the substrate.

In a preferable embodiment of the connector according to the present invention, the ground terminal is in such a bent shape that surface mounting on the substrate is allowed.

In a preferable embodiment of the connector according to the present invention,

- the outer conductor shell includes the two shell mounting portions on opposite sides with respect to the ground terminal side on which the ground terminal is mounted between the mounting portions for groups of terminals, and
- the each mounting portion for a group of terminals is arranged between the ground terminal and the shell mounting portions.

Advantageous Effects of the Invention

In the connector according to the present invention, the ground terminal also serving as the shell mounting portion on the back end side of the outer conductor shell is, passing through between the two terminal groups arranged along the connector fitting direction to face each other, mounted on the substrate between the mounting portion for a group of terminals of the multiple terminals included in one terminal group and the mounting portion for a group of terminals of the multiple terminals included in the other terminal group. Thus, the ground terminal provided on the back end side of the outer conductor shell fulfills a role as a ground electrode for the multiple terminals included in the two terminal groups. Consequently, high-frequency characteristics necessary for high-speed electric signal transfer can be maintained while the number of terminals (specifically, ground terminals arranged between conductor terminals) included in the connector can be reduced.

Moreover, the number of terminals (i.e., the number of components) is reduced so that an internal structure of the connector can be simplified and impedance matching can be easily adjusted.

DESCRIPTION OF THE EMBODIMENTS

Figure 1:
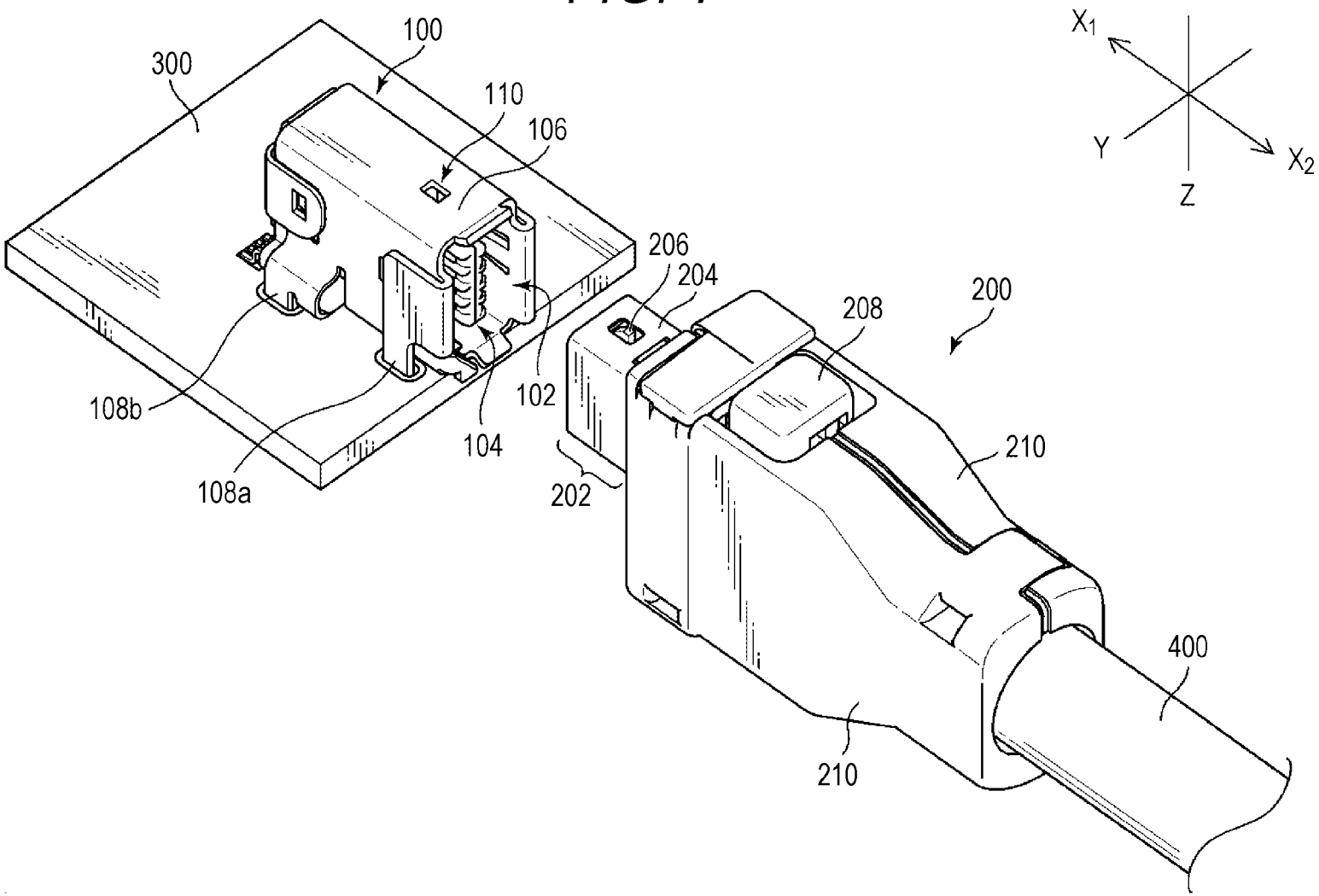
FIG. 1 illustrates a view of outer appearances of a substrate-side connector and a cable-side connector.

Hereinafter, embodiments of the present invention will be described with reference to the drawings. Note that in all figures for describing the embodiments, the same reference numerals are, as a general rule, used to represent the same members, and therefore, repeated description thereof will not be made. Moreover, each embodiment will be independently described, but it does not intended to exclude a combination of components of these embodiments forming a connector.

FIG. 1 illustrates a view of outer appearances of a substrate-side connector and a cable-side connector. A connector fitting direction is an X1-X2 direction (an X-axis direction) in the figure. A tip end side of the substrate-side connector 100 is an X2 direction side, and a tip end side of the cable-side connector 200 is an X1 direction side. A plane perpendicular to a substrate 300 is an X-Z plane, and a plane horizontal (a plane parallel) to the substrate 300 is an X-Y plane. Upper and lower sides along a Z-axis direction in the figure are upper and lower sides of each connector. The same also applies to other figures.

The substrate-side connector 100 includes an insulator 112 (see FIG. 2) holding multiple terminals and forming a fitting raised portion 104 on a side (the X2 direction side) to be connected to the cable-side connector 200, and an outer conductor shell 106 housing the insulator 112 therein. A fitting recessed portion 102 is a space between the fitting raised portion 104 provided on a fitting side (the X2 side) of the outer conductor shell 106 and an inner wall of the outer conductor shell 106. The outer conductor shell 106 includes shell mounting portions 108*a*, 108*b* for mounting and fixing the outer conductor shell 106 onto the substrate 300. The shell mounting portions 108*a*, 108*b* are DIP terminals soldered with the DIP terminals being inserted into holes provided at the substrate 300, but may be terminals mountable on a substrate surface. The shell mounting portions 108*a* are provided at the side surfaces of the connector 100 on tip end side thereof with respect to the shell mounting portions 108*b*.

Moreover, the outer conductor shell 106 includes lock holes 110 to be engaged with lock protrusions 206 of the cable-side connector 200. The lock holes 110 are provided at such positions that the lock holes 110 can engage with the lock protrusions 206 of the cable-side connector 200. In FIG. 1, the lock holes 110 are provided at upper and lower (the upper and lower sides in the Z-axis direction) side walls of the outer conductor shell 106 of the connector 100. As long as the structure is made such that the lock holes 110 can engage with the lock protrusions 206, the lock holes 110 are not necessarily holes penetrating the outer conductor shell. In another embodiment, lock protrusions may be provided at an outer conductor shell of a substrate-side connector, and lock holes may be provided at an outer conductor shell of a cable-side connector.

The cable-side connector 200 includes an outer conductor shell 204 having a fitting portion 202 on a side (the X1 direction side) to be connected to the substrate-side connector 100, i.e., on the tip end side, and housing an insulator configured to hold the multiple terminals, a lock operation button 208 cooperating with the lock protrusions 206 protruding from holes of the outer conductor shell 204, and a cover member covering a connection portion between the outer conductor shell 204 and a cable 400.

The fitting portion 202 is inserted into the fitting recessed portion 102 upon connection with the substrate-side connector 100. The outer conductor shell 204 has, at side walls thereof, the holes allowing the lock protrusions 206 to protrude from the inside. The lock protrusions 206 are provided at such positions that the lock protrusions 206 can engage with the lock holes 110 of the substrate-side connector 100. In FIG. 1, the lock protrusions 206 are provided at the upper and lower (the upper and lower sides in the Z-axis direction) side walls of the outer conductor shell 204 of the connector 200. For the lock protrusions 206, any structure may be employed as long as engagement with the lock holes 110 is allowed.

The lock protrusions 206 are, in the outer conductor shell 204, coupled to the lock operation button 208, and are pushed in in association with pushing in of the lock operation button 208. The lock operation button 208 is pushed in upon connection with the substrate-side connector 100 such that the lock protrusions 206 disengage from the lock holes 110, and the cable-side connector 200 can be pulled out of the substrate-side connector 100.

Figure 2:
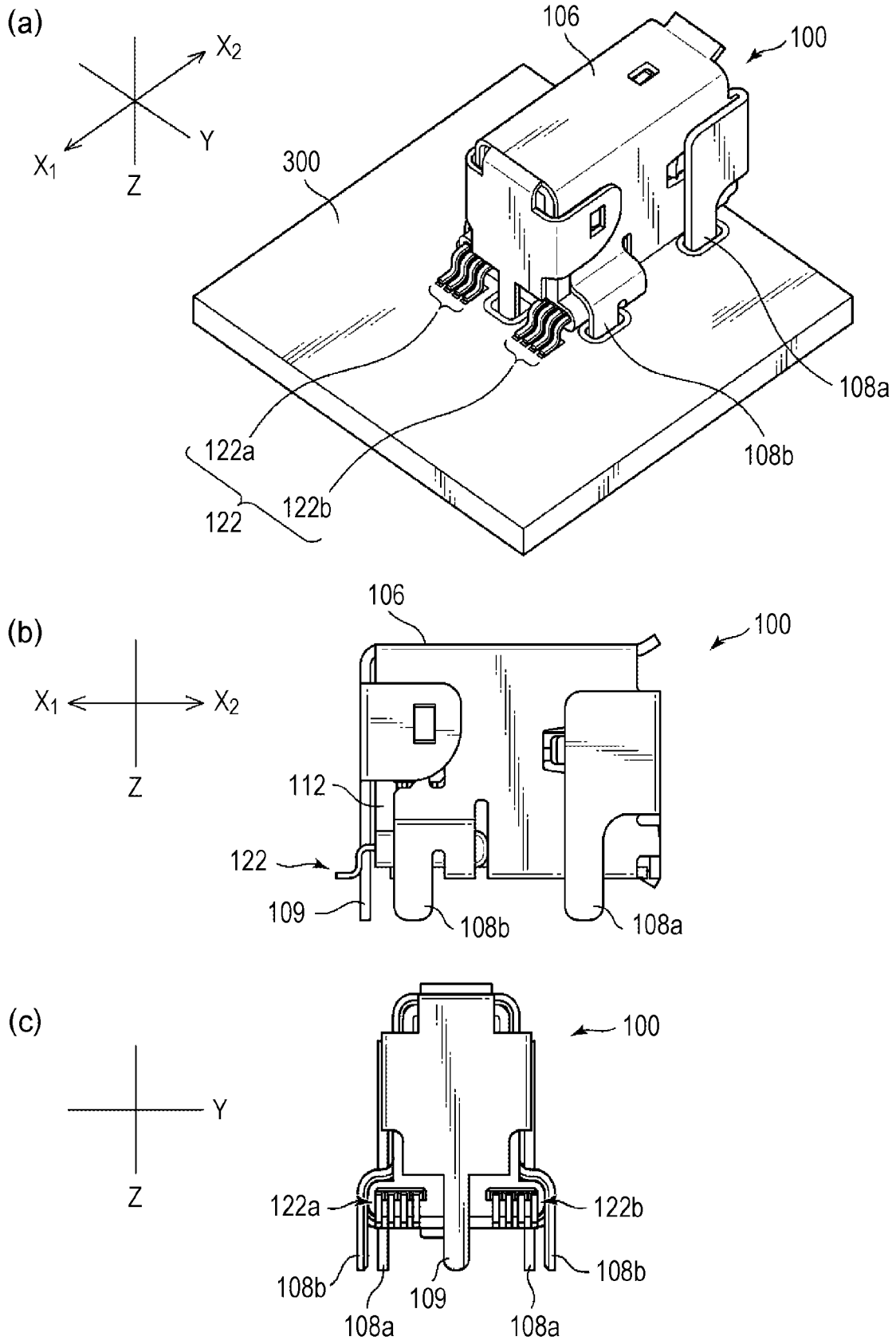
FIG. 2 illustrates views of the outer appearance of the connector according to one embodiment of the present invention.

FIG. 2 illustrates views of the outer appearance of the substrate-side connector according to one embodiment of the present invention. FIG. 2(*a*) is a perspective view of the connector 100 viewed diagonally from a back side (the X1 side), FIG. 2(*b*) is a side view of the connector 100 viewed from a lateral side (a Y side), and FIG. 2(*c*) is a back view of the connector 100 viewed from the back side (the X1 side). The insulator 112 housed in the outer conductor shell 106 holds two terminal groups arranged along the direction of fitting the connector 100 to face each other, and forms the fitting raised portion 102 (see FIG. 1) on a front side (the X2 side) in the fitting direction. In the embodiment illustrated in FIG. 2, a single terminal group includes two terminal pairs including four terminals.

The insulator 112 can be molded integrally with the two terminal groups arranged to face each other along the fitting direction, and can cover at least part of the multiple terminals. The multiple terminals are exposed through the insulator 112 on the back side (the X1 side) of the outer conductor shell 106, and are soldered and fixed onto the surface of the substrate 300 via terminal mounting portions 122 provided at each exposed terminal. The terminal mounting portions 122 are provided at each terminal included in the terminal groups, and a mounting portion for a group of terminals 122 is formed for each terminal group. Each terminal mounting portion 122 is surface-mounted on the substrate 300, but may be configured as a DIP terminal such that the DIP is mounted with the DIP terminal being inserted into a hole provided at the substrate.

A ground terminal 109 is formed integrally with the outer conductor shell, and is provided on the back end side of the outer conductor shell along a back wall (an X1 side wall) of the insulator 112. The ground terminal 109 also serves as a shell mounting portion, and is mounted on the substrate 300 passing through between the exposed two terminal groups coming out of the insulator 112. Specifically, the ground terminal 109 is, by soldering and the like, fixed and mounted onto the substrate 300 in a state in which the ground terminal 109 is inserted into a hole of the substrate 300 between a mounting portion for a group of terminals 122*a* included in one terminal group 120*a* (see FIG. 3) of the two terminal groups held by the insulator 112 housed in the outer conductor shell 106 and a mounting portion for a group of terminals 122*b* included in the other terminal group 120*b* (see FIG. 3). Moreover, as illustrated in FIG. 2(*b*), the ground terminal 109 is, by soldering and the like, fixed and mounted onto the substrate 300 with the ground terminal 109 being inserted into the hole of the substrate 300 between the back wall (the X1 side wall) of the insulator 112 housed in the outer conductor shell 106 and a tip end (an X1 side end portion) of each terminal mounting portion 122.

The ground terminal 109 extends perpendicularly (downward in the Z-axis direction) toward the substrate 300 so that the ground terminal 109 can be mounted with the ground terminal 109 being inserted into the hole provided at the substrate 300. Moreover, in another embodiment, the ground terminal 109 can be in a bent shape (see FIG. 4) so that the ground terminal 109 can be mounted on the surface of the substrate 300.

The outer conductor shell 106 is configured such that the two shell mounting portions 108*b* covering the insulator 112 are, on the back end side of the connector 100, provided on the opposite sides (the lateral portion sides of the connector 100) with respect to the ground terminal 109 side mounted between the mounting portions for groups of terminals 122, and each of the two mounting portions for groups of terminals 122*a*, 122*b* is arranged between the ground terminal 109 and the shell mounting portions 108*b* provided at the side surfaces of the connector 100 on the back end side (the X1 side).

The insulator 112 through which the terminal mounting portions 122*a*, 122*b* are exposed expands outward along a direction (a Y-direction) perpendicular to the direction of fitting the connector 100. That is, the insulator 112 is molded integrally with the terminal groups to cover each of the two terminal groups 120*a*, 120*b* including the terminal mounting portions 122*a*, 122*b*, and the terminal mounting portions 122*a*, 122*b* are exposed through the back wall (a X1 side wall portion) of the insulator 112 expanding outward of the connector 100 (outward along the Y-axis direction). The outer conductor shell 106 is formed in accordance with such an expanded shape, and therefore, the shell mounting portions 108*b* provided on the back end side (the X1 side) of the outer conductor shell 106 are, as illustrated in FIG. 2(*c*), provided outward of the connector 100 with respect to the shell mounting portions 108*a* provided on the tip end side (the X2 side) in the direction (the Y-direction) perpendicular to the fitting direction.

Figure 3:
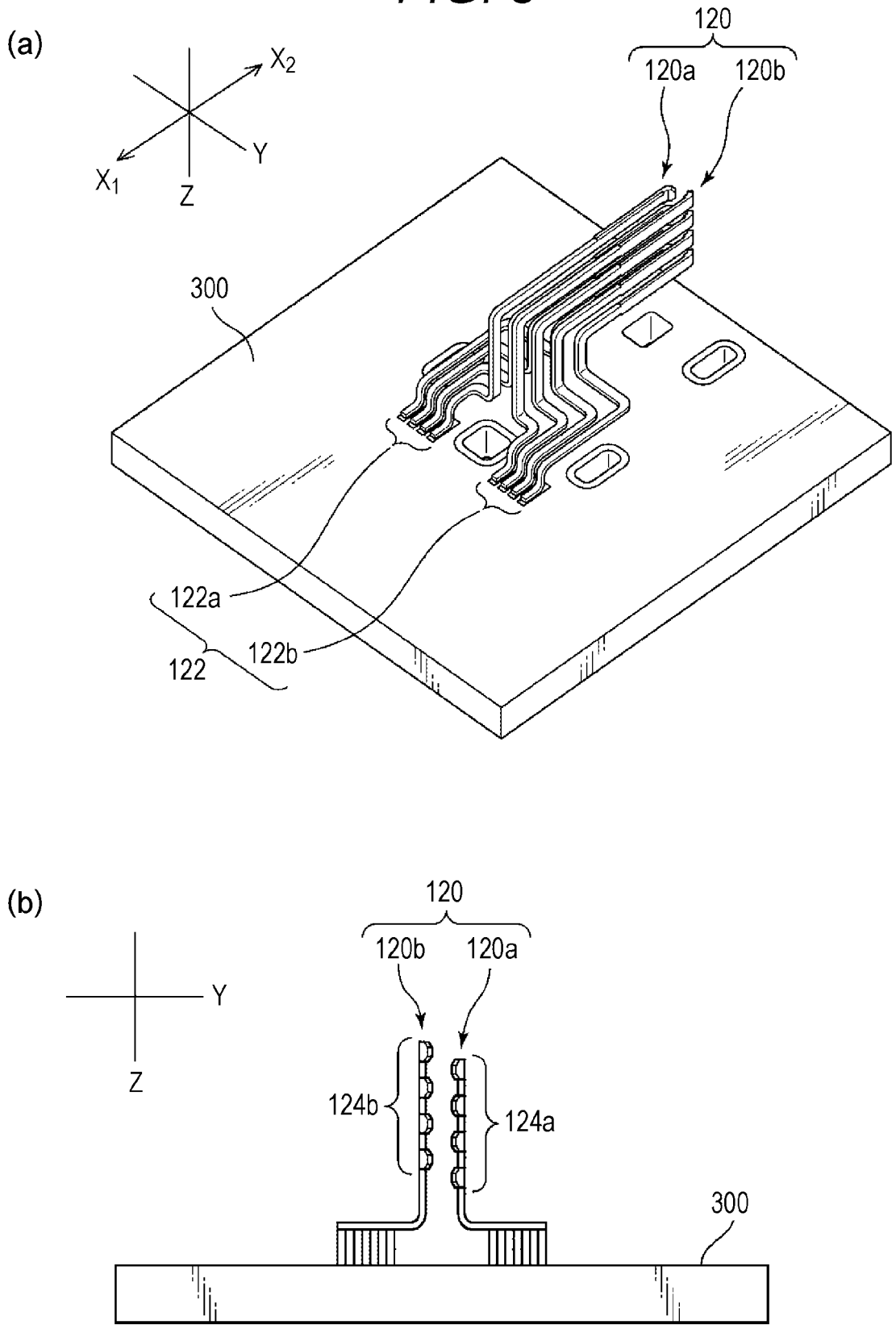
FIG. 3 illustrates views of only a state of terminals, excluding an outer conductor shell and an insulator of the connector illustrated in FIG. 2.

As illustrated in FIG. 2, the ground terminal 109 provided on the back end side of the outer conductor shell 106 fulfills a role as a ground electrode for the multiple terminals included in the two terminal groups 120*a*, 120*b* (see FIG. 3). Thus, high-frequency characteristics necessary for high-speed electric signal transfer can be maintained without the need of providing a ground terminal between each of the multiple terminals for signal transfer. With this configuration, the number of terminals included in the connector can be reduced. Since the number of terminals (i.e., the number of components) is reduced, an internal structure of the connector can be simplified, and can be an internal structure allowing easy adjustment of impedance matching.

FIG. 3 illustrates only a state of the terminals, excluding the outer conductor shell and the insulator of the connector according to one embodiment of the present invention as illustrated in FIG. 2. FIG. 3(*a*) is a perspective view of a terminal group 120 viewed diagonally from the back side (the X1 side), and FIG. 3(*b*) is a front view of the connector 100 viewed from the front side (the X1 side). The terminal group 120 includes four terminal pairs of two terminals. Moreover, in the terminal group 120, the terminal group 120*a* including the half of the four terminal pairs, i.e., two terminal pairs, and the terminal group 120*b* including the remaining two terminal pairs are arranged to face each other along the fitting direction.

In the embodiment illustrated in FIG. 3, the terminal group 120 includes four terminal pairs, i.e., eight terminals, but may include at least one or more terminal pairs. In the case of including an even-number of terminal pairs, the terminal group 120*a* including the half of the even-number of terminal pairs and the terminal group 120*b* including the remaining half of the terminal pairs can be arranged to along the connector fitting direction (the X1-X2 direction) to face each other. The two terminal groups 120*a*, 120*b* include the terminal mounting portions 122*a*, 122*b* at back end side (X1 side) portions, and contact portions 124*a*, 124*b* at tip end side (X2 side) portions.

Each terminal mounting portion 122 is formed in such a manner that a back end side portion of the terminals is bent downward in the perpendicular direction (the Z-axis direction) and a back end side portion with respect to such a bent portion is further bent horizontal (parallel) to the substrate toward the back side (the X1 side). That is, the terminal mounting portion 122 has a shape bent in a single-step shape, and can be surface-mounted on the substrate 300. Moreover, the terminal mounting portion 122 can be a DIP terminal fixable by soldering with the DIP terminal being inserted into a hole of the substrate.

The contact portions 124 are each formed at tip end side portions of the terminals, and are formed wider than other portions of the terminal. The contact portions 124 have, at tip end portions thereof, a shape bent inward of the connector for facilitating contact with terminals of a partner connector (e.g., the cable-side connector 200 illustrated in FIG. 1). The contact portions 124 of each of the terminals are arranged adjacent to each other in the perpendicular direction (the Z-axis direction).

Figure 4:
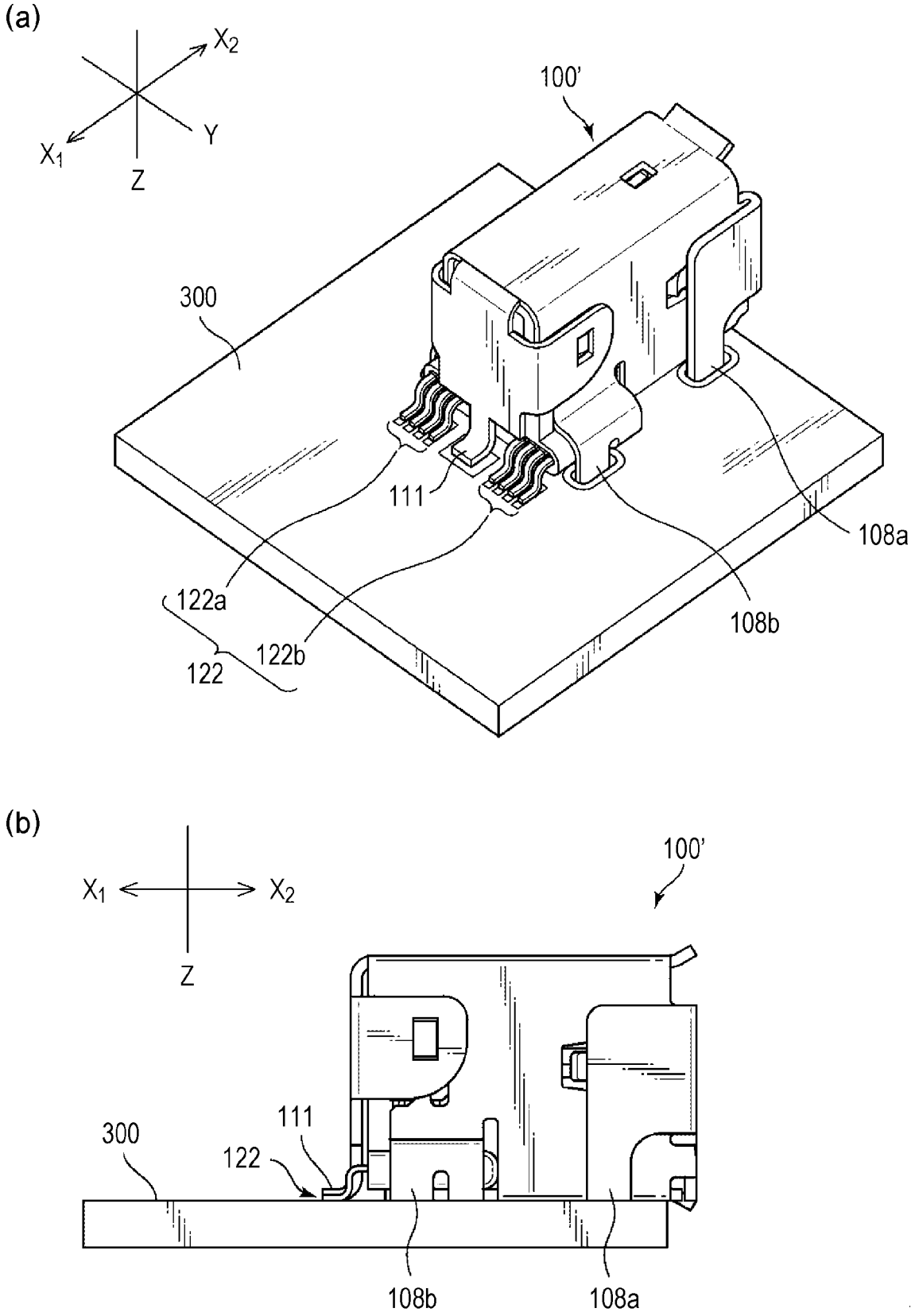
FIG. 4 illustrates views of an outer appearance of a connector according to another embodiment of the present invention.

FIG. 4 illustrates views of an outer appearance of a connector according to another embodiment of the present invention. FIG. 4(*a*) is a perspective view of the connector 100' viewed diagonally from the back side (the X1 side), and FIG. 4(*b*) is a side view of the connector 100' viewed from the lateral side (the Y side). The configuration is the same as that of the connector 100 according to the embodiment illustrated in FIG. 2, except for a ground terminal 111 also serving as a shell mounting portion of an outer conductor shell on the back end side.

The ground terminal 111 is configured such that a tip end portion thereof is bent 90 degrees in the backward direction (the X1 direction) of the connector 100' to extend horizontal (parallel) to the substrate 300. With this configuration, the ground terminal 111 is, by soldering and the like, fixed and mounted onto the surface of the substrate 300. As illustrated in FIG. 4(*b*), a tip end of the ground terminal 111 is arranged at such a position that the tip end of the ground terminal 111 and the tip ends of the terminal mounting portions 122 are on a straight line in the direction (the Y-axis direction) perpendicular to the direction of fitting the connector 100'.

As illustrated in FIG. 4, the ground terminal 111 provided on the back end side of the outer conductor shell 106 also fulfills, as in the connector 100 according to the embodiment illustrated in FIG. 2, a role as a ground electrode for the multiple terminals included in the two terminal groups 120*a*, 120*b*. Thus, the high-frequency characteristics necessary for high-speed electric signal transfer can be maintained without the need for providing a ground terminal between each of the multiple terminals for signal transfer. With this configuration, the number of terminals included in the connector can be reduced. Since the number of terminals (i.e., the number of components) is reduced, the internal structure of the connector can be simplified, and can be the internal structure allowing easy adjustment of impedance matching.

INDUSTRIAL APPLICABILITY

The connector according to the present invention can be utilized when devices are connected via a cable for transferring a high-frequency electric signal by an electronic device such as a measurement device configured to handle a high-frequency signal.

LIST OF REFERENCE NUMERALS

100, 100' Connector
102 Fitting recessed portion
104 Fitting raised portion
106 Outer conductor shell
108*a*, 108*b* Shell mounting portion
109 Ground terminal (shell mounting portion)
110 Lock hole
111 Ground terminal (shell mounting portion)
120, 120*a*, 120*b* Terminal group
122, 122*a*, 122*b* Terminal mounting portion
124 Contact portion
200 Connector
202 Fitting portion
204 Outer conductor shell
206 Lock protrusion
208 Lock operation button
210 Cover member
300 Substrate
400 Cable

The invention claimed is:

1. A connector comprising:
an outer conductor shell;
two terminal groups arranged along a connector fitting direction to face each other; and
an insulator housed in the outer conductor shell, the insulator holding the two terminal groups, wherein
each of the two terminal groups includes at least one or more terminal pairs of two terminals,
each terminal of the terminal pair included in each of the two terminal groups includes
at a tip end side portion of the connector, a contact portion to be connected in contact with a terminal of a partner connector,
at a back end side portion of the connector, a terminal mounting portion to be mounted on a substrate,
the outer conductor shell includes a shell mounting portion for mounting on the substrate, and a ground terminal also serving as a shell mounting portion on a back end side,
the ground terminal is mounted on the substrate between a mounting portion for a group of terminals included in one terminal group of the two terminal groups and a mounting portion for a group of terminals included in the other terminal group, and
the ground terminal is in direct contact with the outer conductor shell.

2. The connector according to claim 1, wherein
the ground terminal is mounted on the substrate passing through between the exposed two terminal groups coming out of the insulator.

3. The connector according to claim 1, wherein
the ground terminal is in a shape extending perpendicularly to the substrate such that mounting is allowed with the ground terminal being inserted into a hole provided at the substrate.

4. The connector according to claim 1, wherein
the ground terminal is in such a bent shape that surface mounting on the substrate is allowed.

5. The connector according to claim 1, wherein
the outer conductor shell includes the two shell mounting portions on opposite sides with respect to the ground terminal side on which the ground terminal is mounted between the mounting portions for groups of terminals, and
the each mounting portion for a group of terminals is arranged between the ground terminal and the shell mounting portions.

6. The connector according to claim 1, wherein the outer conductor shell comprises a back end in a direction of the back end side portion of the connector, and the ground terminal is in direct contact with the outer conductor shell at the back end of the outer conductor shell.

* * * * *